US006923700B2

(12) United States Patent
Kanzaki et al.

(10) Patent No.: US 6,923,700 B2
(45) Date of Patent: Aug. 2, 2005

(54) SHORT-ARC, ULTRA-HIGH-PRESSURE DISCHARGE LAMP AND METHOD OF MANUFACTURE

(75) Inventors: Yoshitaka Kanzaki, Himeji (JP); Toyohiko Kumada, Himeji (JP); Katsuhiko Miyahra, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/715,522

(22) Filed: Nov. 19, 2003

(65) Prior Publication Data

US 2004/0102129 A1 May 27, 2004

Related U.S. Application Data

(62) Division of application No. 09/874,231, filed on Jun. 6, 2001, now abandoned.

(30) Foreign Application Priority Data

Jun. 6, 2000 (JP) ..... 2000-168798

(51) Int. Cl.[7] ..... H01J 9/18; H01J 9/24; H01J 9/32

(52) U.S. Cl. ..... 445/22; 445/26; 445/29

(58) Field of Search ..... 445/22, 26, 29

(56) References Cited

U.S. PATENT DOCUMENTS 4,721,887 A 1/1988 Inukai et al.
5,877,591 A 3/1999 Nagata et al.
6,071,164 A * 6/2000 Vollmer ..... 445/26
6,132,279 A 10/2000 Horiuchi et al.
6,306,002 B1 10/2001 Kaneko et al.
6,307,321 B1 10/2001 Honda et al.
2004/0140769 A1 * 7/2004 Horiuchi et al. ..... 445/27

FOREIGN PATENT DOCUMENTS

| | | |
|---|---|---|
| JP | 48-19029 | 6/1973 |
| JP | 49-57678 | 6/1974 |
| JP | 11-135066 | 5/1999 |
| JP | 11-176385 | 7/1999 |

* cited by examiner

*Primary Examiner*—Mariceli Santiago
(74) *Attorney, Agent, or Firm*—Nixon Peabody LLP; David S. Safran

(57) ABSTRACT

To form side tubes with adequate resistance to pressure, and to provide a short-arc, ultra-high-pressure discharge lamp having such side tubes, and to provide a method of manufacturing such a lamp, a short-arc, ultra-high-pressure discharge lamp (1) has a luminescent tube (10) within which a pair of electrodes (2,2) face each other, and side tubes (11) that extend from opposite sides of the luminescent tube and in which a portion of the electrodes is sealed and in which a small space (B) is formed to enable the electrodes (2) to expand and contract freely without compression along their axes due to a difference in the indices of expansion of the materials that make up the electrodes (2) and the side tubes (11).

1 Claim, 4 Drawing Sheets

SHORT-ARC, ULTRA-HIGH-PRESSURE DISCHARGE LAMP AND METHOD OF MANUFACTURE

This application is a divisional of applicational Ser. No. 09/874,231, filed Jun. 6, 2001 now abandoned.

BACKGROUND OF THE INVENTION

1. Field of the Invention

This invention concerns a short-arc, ultra-high-pressure discharge lamp into which is sealed mercury that has a mercury vapor pressure of at least 160 atmospheres when the lamp is lit, and a method of manufacturing such a lamp. More particularly, the invention is directed to a short-arc, ultra-high-pressure discharge lamp used as a back light in such equipment as liquid crystal display equipment, and a method of manufacturing such a lamp.

2. Description of Related Art

The ability to show images evenly and with adequate chromaticity on a rectangular screen is required for projection-type liquid crystal display equipment, and so metal halide lamps that incorporate mercury or a metal halide have been used as light sources for that application. In recent years, these metal halide lamps have become smaller and approached point light sources, and extremely small inter-electrode gaps have become practical.

In these circumstances, proposals have been made for lamps with unprecedentedly high mercury vapor pressure, such as 160 atmospheres, to replace metal halide lamps. These pressures are intended to suppress the spread of the arc and further increase light output as the mercury vapor increases.

In ultra-high-pressure lamps of this sort, the quartz glass that makes up the side tubes that extend from both sides of the luminescent tube must seal the metallic foil with sufficient tightness. In the manufacturing process to seal the tubes, the quartz glass is heated to a high temperature of, for example, 2,000° C., after which the thick quartz glass contracts slowly, or else the quartz glass is subjected to a pinch seal to increase the tightness of the portion involved.

However, if the quartz glass is raised to too high a temperature, the tightness between the quartz glass and the metallic foil can be raised by the contraction or pinch seal, but there is the problem of cracking of the seal. In the stage where the temperature of the side tube drops at the conclusion of the sealing process, the difference in the indices of thermal expansion of the electrode and the quartz glass cause cracks where the two are in contact.

As shown in FIG. 1, there is a proposal to resolve this problem by wrapping the electrode 2 with coil material 5. This eases the stress on the quartz glass from the thermal expansion of the electrode 2. This type of technology is described in, for example, published Japanese Patent Application H11-176385.

As shown in FIG. 1, however, even when the electrode 2 is wrapped with the coil material 5, very small cracks K occur near the electrode 2 and the coil material 5.

These cracks K are extremely small, but in the event that the mercury vapor pressure in the luminescent tube 10 is around 160 atmospheres, such cracks sometimes lead to breakage of the side tube 11. Moreover, there has been demand in recent years for unusually high mercury vapor pressures of 300 atmospheres. With such high mercury vapor pressure, the cracks K are caused to grow longer when the lamp is lighted, and the breakage of the end tube 11 occurs to a marked extent.

BACKGROUND OF THE INVENTION

This invention is directed to resolving problems of the above indicated type. In particular, it is an object of this invention to form side tubes that have a sufficiently great resistance to pressure, and provide a short-arc ultra-high-pressure discharge lamp with such end tubes as well as a method for manufacturing such lamps.

In accordance with a first embodiment of the invention, a short-arc, ultra-high-pressure discharge lamp comprises a luminescent tube within which a pair of electrodes face each other and side tubes that extend from both sides of the luminescent tube and seal a portion of the electrodes, in which a small space is formed to enable the electrodes to expand and contract freely without compression along their axes that would be caused by a difference in the indices of expansion of the materials that make up the electrodes and the side tubes.

The method of manufacture of a short-arc, ultra-high-pressure discharge lamp in accordance with the invention comprises the following processes:

1) heating the electrodes and metallic foil to a temperature higher than the softening point of the side tubes, and then sealing the electrodes and metallic foil with the side tubes;
2) cooling the sealed side tubes to fix the metallic foil in the end tubes;
3) re-heating the portion of the side tube in which the electrode is sealed, softening the side tube and bringing the side tube into contact with the electrode while in a viscous, fluid state, so that the electrode can rub against the portion of the side tube that is in a viscous, fluid state; and
4) vibrating the re-heated side tube and electrode such that the temperature of the portion of the side tube in which the electrode is sealed reaches a temperature region between the side tube's softening point and its annealing point when the side tube softens and contacts the electrode while in a viscous, fluid state, and the electrode can rub against the portion of the side tube that is in a viscous, fluid state.

DETAILED DESCRIPTION OF THE INVENTION

Figure 2:
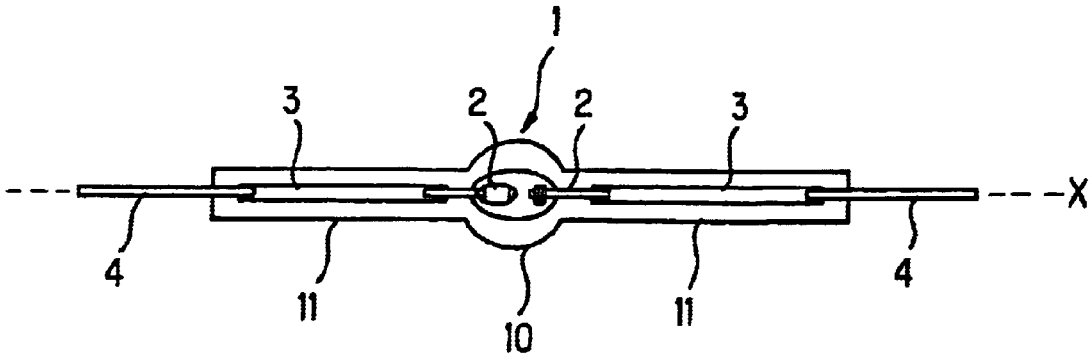
FIG. 2 shows a short-arc, ultra-high-pressure discharge lamp in accordance with the present invention.

FIG. 2 shows a short-arc, ultra-high-pressure lamp 1 in accordance with the present invention in which the discharge lamp 1 has a luminescent portion 10 made of quartz glass nearly at its center, with side tubes 11 on opposite sides. The side tubes 11 are tightly sealed quartz glass.

Within the luminescent portion 10 there is a pair of electrodes 2 made of tungsten, with a gap between them of no more than 2.5 mm. One end of each electrode 2 is in contact with a metallic foil 3, and the metallic foil 3 and a part of the electrode 2 are sealed within a respective side tube 11. The other end of each metallic foil 3 is connected to an external lead 4.

Mercury is contained in the luminescent tube 10 as the luminous substance, and a rare gas, such as argon or xenon, is also included as a start-up gas. The amount of mercury contained is calculated so as to provide a vapor pressure, when the lamp is burning stably, of at least 150 atmospheres, preferably 200 atmospheres or more, and better yet 300 atmospheres or more. For example, to produce a mercury vapor pressure of at least 150 atmospheres, the amount of mercury would be at least 0.15 $mg/mm^3$.

Figure 3:
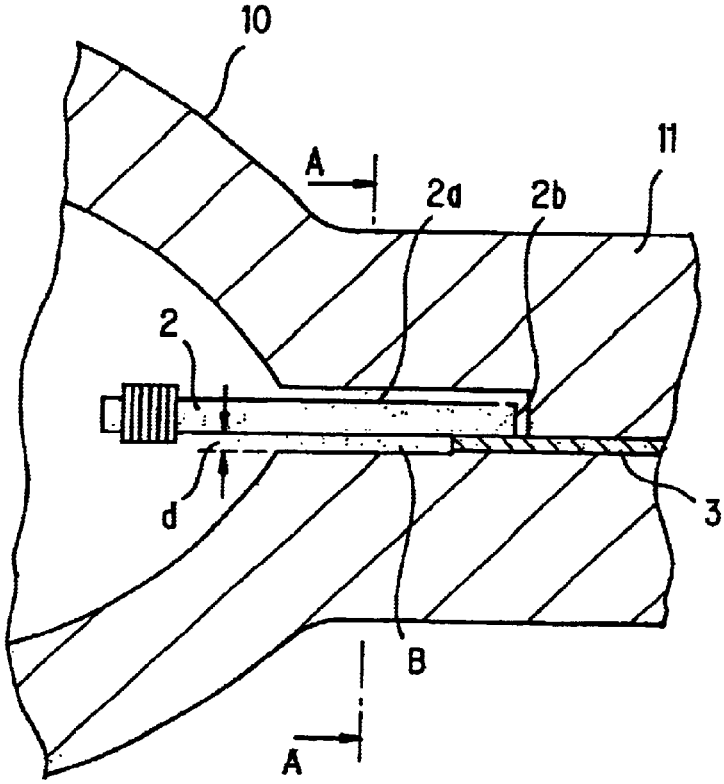
FIG. 3 is an explanatory cross-sectional view of a portion of the short-arc, ultra-high-pressure discharge lamp of FIG. 2.
Figure 4:
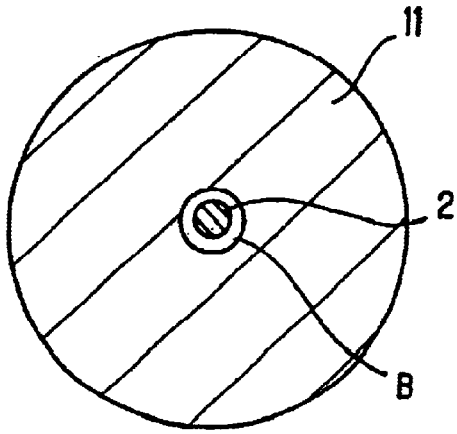
FIG. 4 is a transverse cross section taken along line A—A of FIG. 3.
Figure 5A:
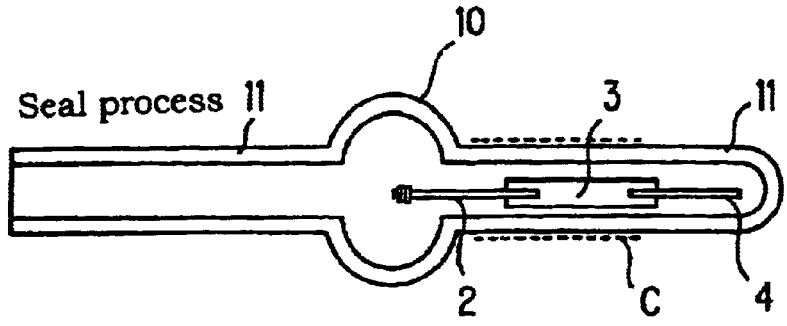
FIGS. 5(*a*)–5(*d*) depicts steps of a method of manufacturing the short-arc, ultra-high-pressure discharge lamp of this invention.
Figure 5B:
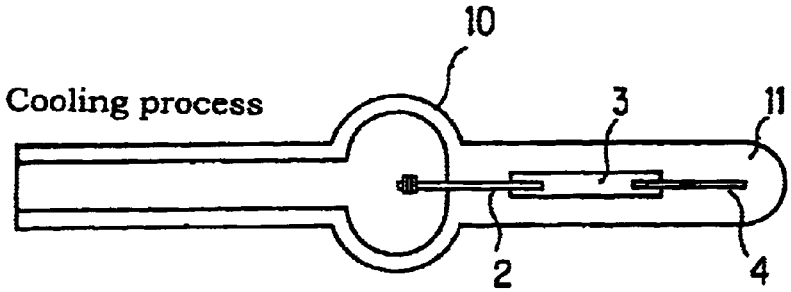
Figure 5C:
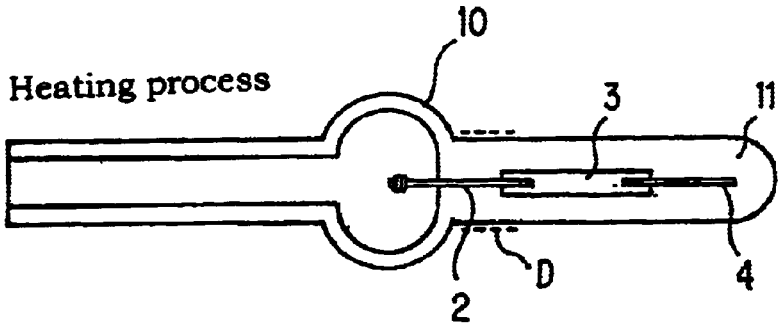
Figure 5D:
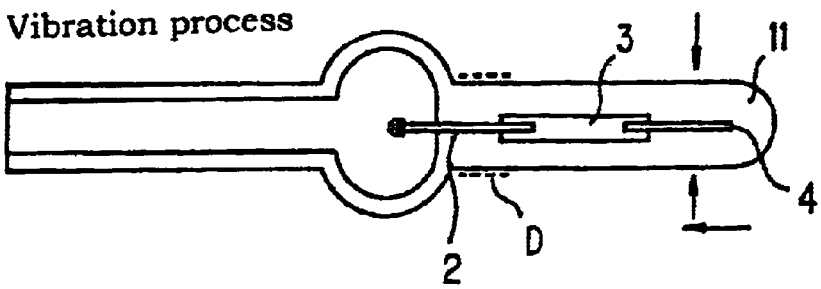

FIG. 3 shows an enlarged detail of the boundary between the luminescent tube 10 and the side tube 11, and FIG. 4 is a section taken at line A—A of FIG. 3. Now, the gap B shown in FIGS. 3 & 4 is in reality very small, as stated below, but has been enlarged for convenience of explanation.

Within the side tube 11, as shown in FIGS. 3 & 4, the electrode 2 is attached only where it is welded to the metallic foil 3; in the rest of that region, the gap B is present between the electrode and the quartz glass. In specific terms, the electrode sides 2*a* and the electrode end 2*b* do not contact the side tube 11 (quartz glass).

Next, the method of manufacture of the short-arc, ultra-high-pressure discharge lamp will be explained using FIG. 5.

Sealing Process

FIG. 5(*a*) shows the sealing process in which an electrode assembly, comprising an electrode 2, metallic foil 3 and an external lead 4 formed into a single unit, is inserted into a glass bulb made of quartz glass that comprises the luminescent tube 10 and a side tube 11*a*.

Next, the electrode 2 is positioned so that its tip is exposed within the luminescent tube 10, and the stem of the electrode 2 and the metallic foil 3 are located in the side tube 11.

Next, as shown at C in the figure, the side tube 11*a* that encompasses the electrode 2 and metallic foil 3 is heated to a temperature above the softening point of the side tube 11*a*. To be specific, when the side tube is made of quartz glass, the softening point is 1,680° C., and so the side tube 11*a* can be heated using a gas burner to a temperature of about 2,000° C.

In this sealing process, the side tube 11*a* is already closed on one side. Therefore, the pressure within the glass bulb can be reduced to 100 Torr, for example, through the open end of the other side tube 11*b*. Then, when the side tube 11*a* is heated, that portion will be reduced in diameter, and the electrode 2 and metallic foil 3 will be sealed by that means.

Now, rather than using negative pressure in the glass bulb in this way, it is possible to use a pincer to seal the side tube 11 after heating it.

Cooling Process

Figure 1:
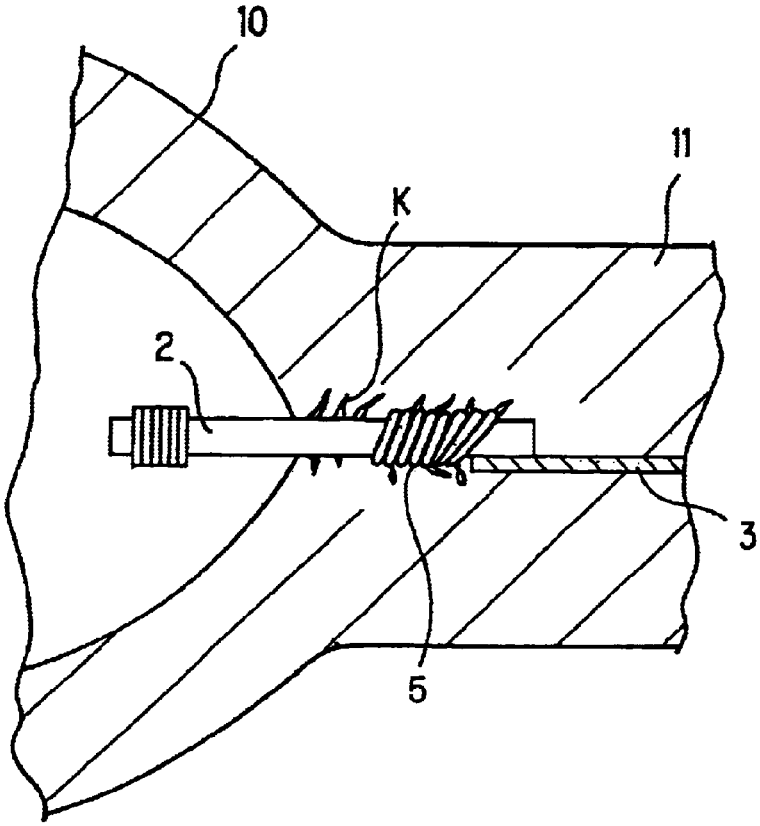
Fig. 1 (Prior Art)
FIG. 1 is an explanatory cross-sectional view of a portion of a conventional short-arc, ultra-high-pressure discharge lamp.

Next, FIG. 5(*b*) shows the cooling process during which the heated side tube 11 is cooled either by forced cooling or natural cooling, and continues until the temperature at which the metallic foil 3 is fixed in the side tube 11, for example 1,200° C., is reached. This cooling process results in fusing of parts of the electrode 2 to the side tube 11, but that does not mean that the full length of the electrode 2 is fused to the material that makes up the side tube 11. That is because the material that makes up the electrode 2, such as tungsten, and the material that makes up the side tube, such as quartz glass, have different indices of thermal expansion, and so part of the fused portions of the electrode 2 and the side tube 11 (the portion fused in the sealing process) separate. It is when this separation occurs that the small cracks K (FIG. 1) develop.

Heating Process

Next, FIG. 5(*c*) shows the heating process, which follows the cooling process, in which the portion indicated by D in the figure is re-heated. The heating is performed using a gas burner, for example, and continues until the material that makes up the side tube 11, such as quartz glass, is in a viscous, fluid state and is again in contact with the electrode 2, so that the materials that make up the electrode 2 and the side tube 11 are free to rub against each other.

This heating process is a matter of re-heating just the region of the side tube 11 indicated by D in the figure, and so the region where the metallic foil 3 is already sealed and fixed is not heated. Therefore, there is no effect at all on the tightness of the seal between the metallic foil 3 and the side tube 11. By carrying out this re-heating, it is possible to reduce the number of small cracks near the electrode 2.

Vibrating Process

Next, FIG. 5(*d*) shows the vibrating process, which follows the heating process, while the temperature of the region D of the side tube 11 is below the softening point but above the annealing point of the material making up the side tube. Vibration is applied to the end tube 11 in the direction shown by either the parallel arrow or perpendicular arrows in the figure.

For example, when the material making up the side tube 11 is quartz glass, the softening point temperature is 1,680° C. and the annealing point temperature is 1,210° C. Thus, the region D of the side tube 11 is kept in a viscous, fluid state and the electrode 2 and the quartz glass 11 are free to rub against each other. This vibration causes a forced, relative slippage between the electrode 2 and the side tube 11, and creates a gap between the them. This is because, when the side tube 11 cools, the electrode 2 contracts much more than the side tube 11 because of the different indices of thermal expansion of the quartz glass side tube 11 and the tungsten electrode 2, and at the same time, the viscous fluidity of the side tube 11 disappears.

The result, as shown in FIG. 3, is that the electrode 2 in the side tube 11 is separated from the side tube 11 for its full length except for the portion welded to the metallic foil 3, and a gap B exists between the electrode 2 and the side tube 11. In other words, this gap B is caused by the difference in the indices of thermal expansion of the electrode 2 and the material that makes up the side tube 11; the electrode 2 is separated from the side tube 11, and a small gap is formed that enables the electrode 2 to expand and contract without constraint in the axial direction.

Because the temperature of region D of the side tube 11 is below the temperature of the softening point of the material that makes up the side tube (1,680° C. in the case of quartz glass), the side tube 11 is not deformed when vibration is applied to it, and consequently, the axis of the electrode is not displaced greatly.

The direction of the vibration applied to the glass tube 11 can be either that in the direction shown by the parallel arrow or that shown by the perpendicular arrows in FIG. 5(*d*). Moreover, the method by which the vibration is applied can be that of directing ultrasonic waves at the side tube 11, or that of applying a vibrator to the side tube perpendicular to the axis of the tube, or that of applying shock through a pressure material in the direction of the axis of the tube. Any method that applies vibration to the side tube 11 will do.

Now, following completion of these processes, the required amounts of mercury and rare gas are placed in the luminescent tube 10, and the same processes of sealing, cooling, heating and vibrating are used in the manufacture of the electrode in the side tube 11*b*.

The gap B that occurs between the electrode and the material that makes up the side tube, as shown in FIGS. 3 & 4, is determined by the difference in indices of thermal expansion of the material that makes up the electrode and the material that makes up the side tube. If the electrode is made of tungsten and the material of the side tube is quartz glass, the width d of the gap B (see FIG. 3) will be in the range from 6 to 16 $\mu$m; gap B will measure 4 to 5 mm in the direction of the length of the electrode.

The method of confirming the existence of the gap is explained next.

The luminescent tube 10 is cut in a direction intersecting with the tube axis X, and the severed lamp is submerged in an electropositive aqueous solution of fuchsin. The reagent will surround the full circumference of the electrode 2 within the side tube, confirming that the gap exists.

Another method of confirmation is to cut through the side tube 11 at section A—A shown in FIG. 3, or at another location and using an electron microscope to examine the surface of the side tube 11 facing the electrode 2; the surface of the side tube 11 where the gap is will be smooth. If there is no gap and the electrode 2 is adhered to the side tube 11 and only separates in the cutting process, then the surface of the side tube 11 will be rough, as though the glass were stripped off. The existence of the gap can be confirmed by this difference in surfaces.

Thus, by forming a small gap B between the side tube 11 and the electrode 2 that is sealed into the side tube 11, it is possible to prevent the occurrence of small cracks in the side tube 11.

Therefore, this gap B will be able to absorb the expansion of the electrode 2 within the side tube 11 at high temperatures when the lamp is lit. Because the electrode 2 will not push against the inside of the side tube 11, the side tube 11 will not break, even though the mercury vapor pressure in the luminescent tube is extremely high.

A numerical example of the short-arc, ultra-high-pressure discharge lamp of this invention is described next.

| | |
|---|---|
| Cathode diameter: | 0.8 mm |
| Anode diameter: | 1.8 mm |
| Side tube outer diameter: | 6.0 mm |
| Total lamp length: | 65.0 mm |
| Side tube length: | 25.0 mm |
| Capacity of luminescent tube: | 0.08 cc |
| Inter-electrode gap: | 2.0 mm |

-continued

| | |
|---|---|
| Rated voltage: | 200 V |
| Rated current: | 2.5 A |
| Mercury content: | 0.15 mg/mm$^3$ |
| Rare gas: | Argon at 100 Torr |

Other implementations of this invention are explained below.

Figure 6:
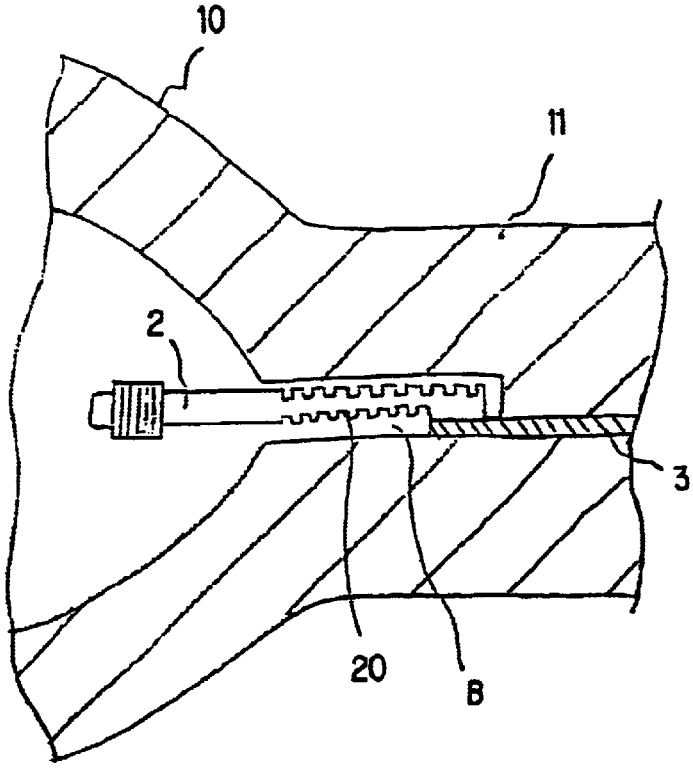
FIG. 6 another embodiment of a short-arc, ultra-high-pressure discharge lamp in accordance with the invention.

FIG. 6, like FIG. 3, shows a detail of the luminescent tube 10 and the side tube 11. In this implementation, that part of the stem of the electrode 2 that is located within the side tube 11 is made with a ridged surface 20. This ridged portion 20 has a depth of 1.0 to 100 $\mu$m (the ridges are exaggerated in the drawing).

By using this ridged portion 20 it is possible, in the vibrating process, to form gap B more certainly. The reason for this is not entirely clear, but it is thought that the quartz glass that enters between the ridges during the heating process is thrown out by the vibrations applied from the outside, and that the gap B is formed by that action.

What is claimed is:

1. A method of manufacturing a short-arc, ultra-high-pressure discharge lamp having a luminescent tube containing a pair of facing electrodes, and side tubes extending from opposite sides of the luminescent tube, a portion of the electrodes being sealed within said side tubes, comprising the steps of:

1) sealing an electrode and a metallic foil connected thereto within one of the side tubes by heating the side tube to a temperature higher than the softening point of the side tubes;

2) following said sealing, cooling the side tube to seal and fix the metallic foil in the side tube;

3) after said cooling, re-heating a portion of the side tube in which the electrode is sealed so as to soften said portion of the side tube and produce contact with the electrode while said portion is in a viscous, fluid state; and 4) vibrating the re-heated side tube, while the temperature of the portion of the side tube in which the electrode is sealed is in a temperature range between a softening temperature and an annealing temperature of the side tube, in a manner causing the electrode to rub against the contacting portion of the side tube while said portion is in a viscous, fluid state.

* * * * *